US005116207A

United States Patent [19]

Doolittle et al.

[11] Patent Number: 5,116,207

[45] Date of Patent: May 26, 1992

[54] U-SHAPED COMPRESSOR RESERVOIR

[75] Inventors: Stephen D. Doolittle, Davidson; Bobby E. Finchum, Gastonia, both of N.C.

[73] Assignee: Ingersoll-Rand Company, Woodcliff Lake, N.J.

[21] Appl. No.: 650,294

[22] Filed: Feb. 4, 1991

[51] Int. Cl.[5] ..... F04B 41/02

[52] U.S. Cl. ..... 417/312; 417/234

[58] Field of Search ..... 417/312, 313, 234, 410, 417/415, 423.14, 423.15

[56] References Cited

U.S. PATENT DOCUMENTS 449,267 3/1891 Maraun .
590,993 10/1897 Lochmann .
1,585,726 5/1926 Lawton .
2,047,539 7/1936 Wolf .
2,059,927 11/1936 Beck .
2,506,412 5/1950 Chausse .
2,942,615 6/1960 Dayton .
3,724,497 4/1973 Federer et al. .
3,753,443 8/1973 Sorimachi et al. .
4,264,282 4/1981 Crago ..... 417/312
4,836,414 6/1989 Credle, Jr. et al. .
4,969,576 11/1990 Merrill et al. .

FOREIGN PATENT DOCUMENTS 609443 10/1948 United Kingdom .
688098 2/1953 United Kingdom .

*Primary Examiner*—Leonard E. Smith
*Attorney, Agent, or Firm*—Glenn B. Foster

[57] ABSTRACT

An apparatus includes a compressor having an outlet. A U-shaped reservoir, having a substantially constant internal cross section, is in fluid communication with the outlet. The reservoir has two leg portions and a connecting portion, the compressor being located between the two leg portions wherein an overall dimension of the apparatus is reduced. This apparatus may be used for dispensing soft drinks, beer and the like. It is especially useful where the width of the compressor reservoir unit is critical.

11 Claims, 3 Drawing Sheets

U-SHAPED COMPRESSOR RESERVOIR

BACKGROUND OF THE INVENTION

This invention relates generally to compressors, and more particularly to configurations of the reservoir which the compressor pressurizes wherein the space, especially the width, taken up by the compressor and reservoir is minimized.

Combined compressor—reservoir units have recently been applied to beverage dispensing units capable of dispensing soft drinks, beer and the like. In these units, the compressor and the reservoir are separated. Not only does the separation of the compressor and the reservoir result in bulkiness and difficulty in transport, but since the compressor is not covered, whatever noise is produced by the compressor is not muffled. The compressor is also readily exposed to dirt in these designs.

The foregoing illustrates limitations known to exist in present compressor—reservoir units. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus including a compressor having an outlet. A U-shaped reservoir, having a substantially constant internal cross section, is in fluid communication with the outlet. The reservoir has two leg portions and a connecting portion, the compressor being located between the two leg portions wherein an overall dimension of the apparatus is reduced.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
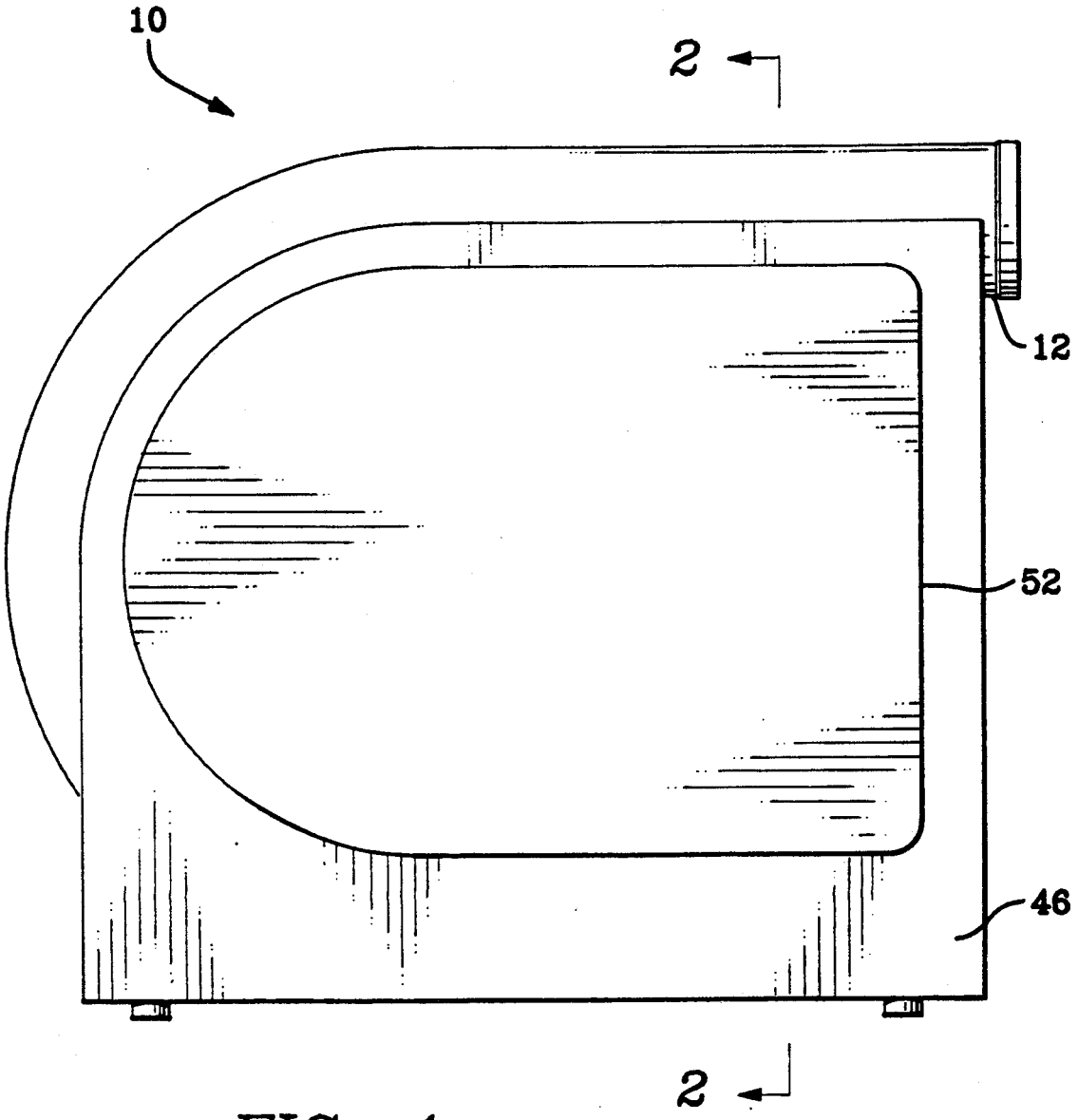
FIG. 1 is a side elevational view illustrating an embodiment of U-shaped compressor reservoir of the instant invention.
Figure 3:
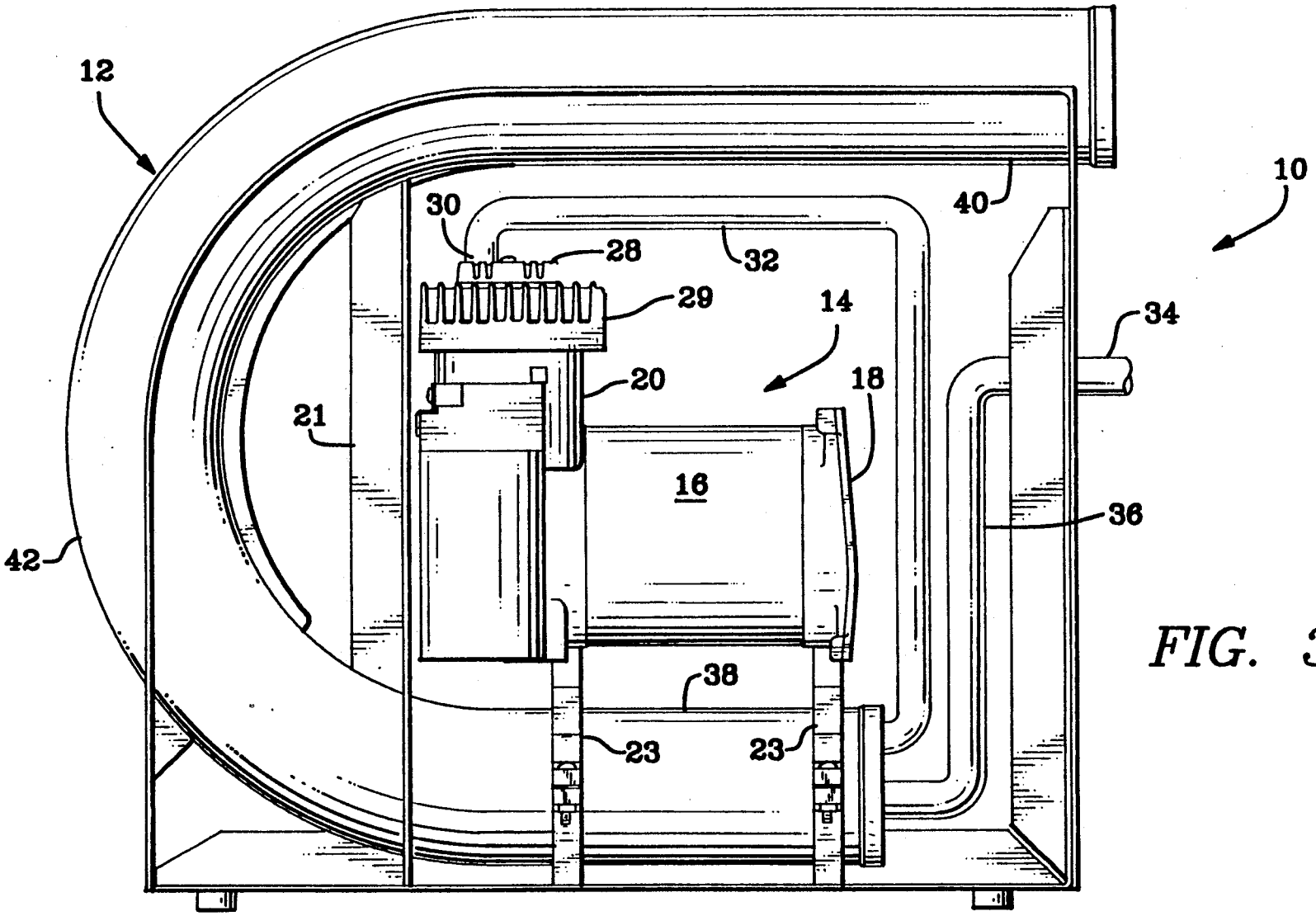
FIG. 3 is a view similar to FIG. 1 with a portion of one of the side faces of the housing broken away.

A compressor—reservoir unit 10 illustrated in FIGS. 1 and 3 includes a reservoir 12 and a compressor portion 14. The compressor portion 14 comprises a driver 16 (which may be a motor, engine, or other device capable of producing a motive force) for driving a fan 18 and a compressor 20. The compressor portion 14 is securely mounted to the reservoir by mounting brackets 21 and 23

The fan 18 performs two functions. Initially it propels cool ambient air through passages 22 and 24 to cool driver 16, frame and cylinder 28 and cylinder head 29. Second, once the ambient air has passed by the driver 16 and is contained in space 26 some of it is compressed by compressor 20.

The compressor 20 includes an inlet segment 28 and an outlet 30. The outlet 30 is in fluid communication with reservoir 12 via conduit 32. The reservoir 12 is in fluid communication with external supply 34 by conduit 36.

Figure 2:
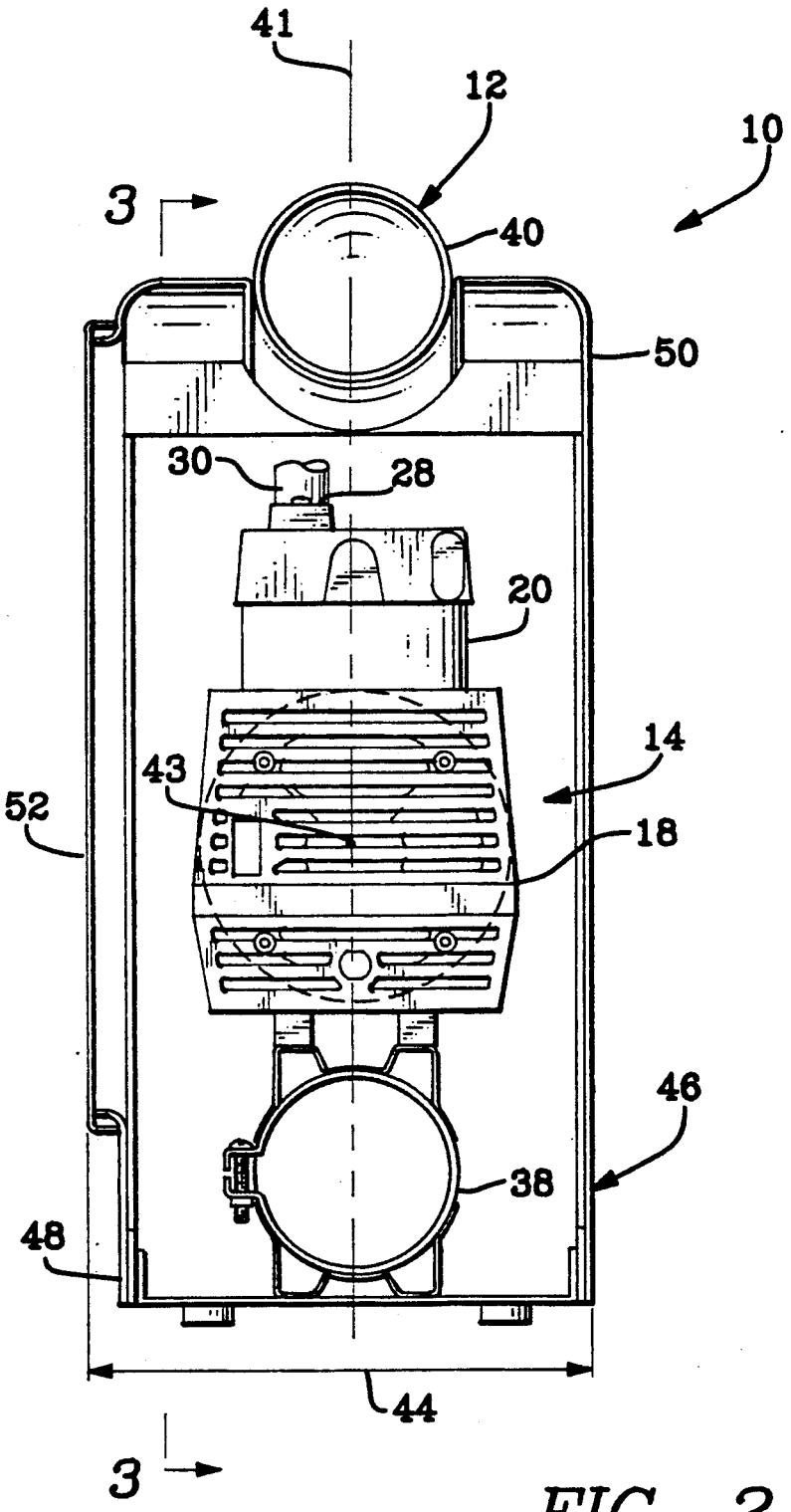
FIG. 2 is an end cross sectional view as taken along sectional lines 2—2 of FIG. 1.

The reservoir 12 is formed in a generally U-shape having two leg portions 38, 40 and a connecting portion 42. Internal cross sections of all three portions are similar. The compressor portion 14 is located between the two leg portions 38, 40. In FIG. 2, an end view of plane 41 is illustrated. The same plane 41 extends through both of the leg portions 38, 40 as well as an axis 43 of the compressor portion 14.

This reservoir configuration maximizes the volume of the reservoir 12 while minimizing the volume which the compressor reservoir unit 10 occupies. This configuration is especially useful where an overall width 44 of the compressor reservoir unit 10 must be minimized. While the reservoir may have any common cross section, a circular cross section provides the greatest resistance against failure for a given reservoir wall thickness, although an elliptical cross-section (for example) would not alter the intent of this invention.

A housing 46 (see FIGS. 1 and 2) encases the entire compressor portion 14 and a portion of the reservoir 12. The housing 46 includes two side faces 48, 50, one of which contains an access port 52 which may be removed for repair, inspection and cleaning of the compressor portion 14. The housing functions to muffle noise produced by the compressor 20 and the driver 16 and to reduce exposure of the compressor portion 14 to dirt and debris.

It is within the anticipated scope that the present invention is especially applicable where space is limited, and wall mounting may be desirable, such as convenience stores or gas stations. The instant invention may be used to supply compressed air for any desired use, and is especially applicable to beverage vending machines, compressed air machines for inflation of tires or a combination of the above.

What is claimed is:

1. An apparatus comprising:

a compressor having an inlet and an outlet;

a U-shaped reservoir, having a substantially constant internal cross section, in fluid communication with the outlet, the reservoir having two leg portions and a connecting portion, wherein a plane extending through an axis of the compressor also extends through both leg portions, the compressor being located between the two leg portions wherein an overall dimension of the apparatus is reduced;

driver means, located between the leg portion, for providing motive force to the compressor;

fan means for providing air to the compressed air inlet, wherein the fan means cools the driver; and housing means, which extend between the two leg portions and encases the compressor, the driver means and the fan means, for muffling noise produced by the compressor, driver means and the fan means.

2. An apparatus comprising:

a compressor having an inlet and an outlet; and a U-shaped reservoir, having a substantially constant internal cross section, in fluid communication with the outlet, the reservoir having two leg portions and a connecting portion, wherein a plane extending through an axis of the compressor also extends through both leg portions, the compressor being located between the two leg portions wherein an overall dimension of the apparatus is limited.

3. The apparatus as described in claim 2, further comprising:

a housing which extends between the two leg portions and encases the compressor.

4. The apparatus as described in claim 3, wherein the housing muffles noise produced by the compressor and a driver.

5. The apparatus as described in claim 3, wherein the housing reduces exposure of the compressor to dirt.

6. The apparatus as described in claim 2, wherein the internal cross section is cylindrical.

7. The apparatus as described in claim 1, further comprising:

bracket means for rigidly securing the compressor to the reservoir.

8. The apparatus as described in claim 2, further comprising:

fan means for providing air to the compressor inlet.

9. The apparatus as described in claim 2, further comprising:

a driver means for providing motive force to the compressor.

10. The apparatus as described in claim 9, wherein the driver means is located between the two leg portions.

11. The apparatus as described in claim 9, further comprising fan means for providing air to the compressed air inlet, wherein the fan means cools the driver and compressor.

* * * * *